US005551452A

United States Patent [19]

Barlow

[11] Patent Number: 5,551,452

[45] Date of Patent: Sep. 3, 1996

[54] HAIRPIECE WITH ADJUSTABLE SUPPORT LOOP

[76] Inventor: Eslie O. Barlow, 1354 S. 1000 West, Salt Lake City, Utah 84104

[21] Appl. No.: 452,374

[22] Filed: May 26, 1995

[51] Int. Cl.[6] ..... A41G 5/00

[52] U.S. Cl. ..... 132/54; 132/53; 132/201; 24/115 H

[58] Field of Search ..... 132/53, 54, 65.1, 132/66.1, 273, 275, 201; 24/115 H, 115 K, 129 R

[56] References Cited

U.S. PATENT DOCUMENTS

| | | | |
|---|---|---|---|
| 4,600,029 | 2/1986 | Ueberschaar . | |
| 4,819,671 | 4/1989 | Walker | 132/54 |
| 5,020,192 | 6/1991 | Gerlach | 24/129 R |
| 5,121,761 | 6/1992 | Meister | 132/53 |

*Primary Examiner*—John G. Weiss
*Assistant Examiner*—Pedro Philogene
*Attorney, Agent, or Firm*—Larson and Taylor

[57] ABSTRACT

An adjustable hair piece construction includes a filamentary support element formed into a loop so as to fit around the head of a wearer. Hair is affixed to the loop element so as to, in use, hang down therefrom. An adjustment assembly for adjusting the size of the loop includes an abutment member including first a second bores therethrough. Portions of the support element extend through each of the bores so that the abutment member is movable on the support element between stops at the ends of the latter. A releasable diameter fixing member is movable along the support element between fixed positions. In such a fixed position, and with one end of the abutment member in engagement with one of the stops, the fixing member engages the other end of abutment member so as to fix the position of the abutment member and thus fix the size of the loop.

18 Claims, 2 Drawing Sheets

HAIRPIECE WITH ADJUSTABLE SUPPORT LOOP

FIELD OF THE INVENTION

The present invention relates to hairpieces, "hair extensions" and like devices of the type comprising a thin threadlike or filamentary loop or circlet which fits over the head of a wearer and, more particularly, to an improved device of this kind wherein the loop or circlet is adjustable.

BACKGROUND OF THE INVENTION

So-called "hair extensions" are widely advertised, including through television "infomercials," and in general, are used to add to or otherwise augment the hair of the user so as to cover bald spots or areas where the hair is thinning, to produce different styling effects, or to simply add to the shape or fullness of the existing hair. The new hair is supported on the head of a user in a number of different ways including bands, clips and caps which are secured to or fit over or around the head.

A hairpiece or hair extension of particular interest here is that disclosed in U.S. Pat. No. 4,600,029 to Ueberschaar. This patent discloses a hairpiece comprising a plurality of individual hairs adjustably secured around an endless circular filament or filaments referred to as a filamentary circlet. The circlet fits over and around the head and the individual hairs hang down therefrom. The individual hairs are knotted to the circlet and can be adjustably moved to the desired location so that, for example, the hair can be moved to a location where the natural hair is thin.

A disadvantage of this type of hairpiece is that the circlet, being an endless loop, is of a fixed diameter so that it will fit or lie differently on different wearers depending on the size of their heads. Thus, the overall effect produced by the hairpiece can differ widely for different wearers. For example, where fullness is required in a particular area to simulate a specific hairstyle, it may not be possible to achieve such fullness in that area where the circlet sits up high upon the head for a wearer with a large head or is disposed very low down on the head for a wearer with a small head.

Providing adjustability in such a circlet presents problems. For example, the filament is difficult to work with because of its very small diameter. Further, any adjustment device provided must be very small so as to be virtually invisible and completely unobtrusive in the hair. In additional and perhaps more importantly, it is critical that any adjustment to be made be "semi-permanent" in the sense that once a particular diameter is selected it should remain fixed, within limits. In this regard, it would obviously be highly undesirable for the circlet to inadvertently expand and slip in place on the head of the wearer. However, on the other hand, the first diameter selected should not be completely permanent or fixed, after selection, in the event that the wearer should desire to change the diameter for whatever reason (e.g., to effect a different hair style). Thus, the capability of further adjustment must be maintained despite the need for a "semi-permanent" fixing of each diameter selected. Moreover, the adjustment device should be inexpensive, durable and easy to use.

SUMMARY OF THE INVENTION

According to the invention, a hair piece of the type discussed above is provided which enables the size of the opening or loop formed by the hair support element to be varied at will by the wearer and which, at the same time, possesses all of the desirable characteristics discussed above.

In accordance with a preferred embodiment thereof, the adjustable hair piece construction of the invention comprises an elongate support element having two free ends and being formed into a loop so as to fit around the head of a wearer; hair affixed to said loop formed by the support element so as to, in use, hang down therefrom; and adjustment means for adjusting the size of said loop. The adjustment means comprises an abutment member including first and second bores therethrough between first and second ends thereof. Portions of the support element extend through each of said first and second bores so that said abutment member is movable on said support element. The support element includes stop means at said free ends for capturing said abutment member on said support element between said free ends. The adjustment means further comprises releasable fixing means, movable along the support element between substantially fixed positions, for, in a substantially fixed position thereof and with said first end of said abutment member in engagement with one of said stop means, engaging the second end of abutment member so as to fix the position of said abutment member and thus fix the size of said loop.

In an advantageous implementation, the stop means comprise individual knots formed in the support element at said free ends.

Preferably, the support element comprises a length of monofilament line. The monofilament line has a diameter of between 10 and 30 thousandths of an inch and preferably, the diameter is between 12 and 25 thousandths of an inch. In a preferred implementation, the fixing means comprises a knot tightened down on the support element. Preferably, the knot is made of Dacron, and comprises a multiple loop knot. In a specific, advantageous implementation the knot comprises an ice fishing knot.

Other features and advantages of the invention will be set forth in, or apparent from, the following detailed description of preferred embodiments of the invention.

BRIEF DESCRIPTION OF THE DESCRIPTION OF THE DRAWINGS

DESCRIPTION OF THE PREFERRED EMBODIMENTS

Figure 1:
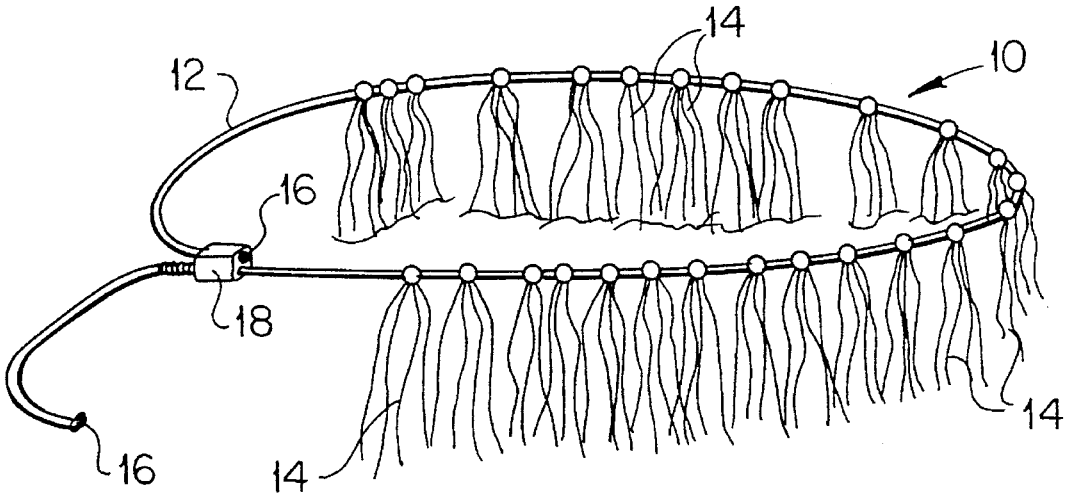
FIG. 1 is a perspective view, partially broken away, of a hairpiece or hair extension incorporating an adjustable support element in accordance with a preferred embodiment of the invention.

Referring to FIG. 1, a perspective view is provided of an adjustable hairpiece or hair extension, generally denoted 10, which is constructed in accordance with the present invention. The hairpiece 10 comprises a filamentary circlet or support element 12 having a plurality of individual hairs or groupings or clumps of hair, denoted 14, affixed thereto. Briefly stated, in use, the support element 12 is placed on and around the hair of a wearer so that as to lay on the scalp of the wearer between adjacent roots of the natural hair, and the hair 14 hangs down from support element 12 so as to be sandwiched between, and blend in with, the natural hair. The hairpiece 10 is of the general type disclosed in U.S. Pat. No. 4,600,029 to Ueberschaar mentioned above, the subject matter of which is hereby incorporated by reference. However, it will be understood, for example, that the nature of the hair or hair groupings 14, and the manner in which the hair 14 is affixed to support element 12, form no part of this invention and that the invention is certainly not limited to the teachings of the Ueberschaar patent in these regards.

Figure 2:
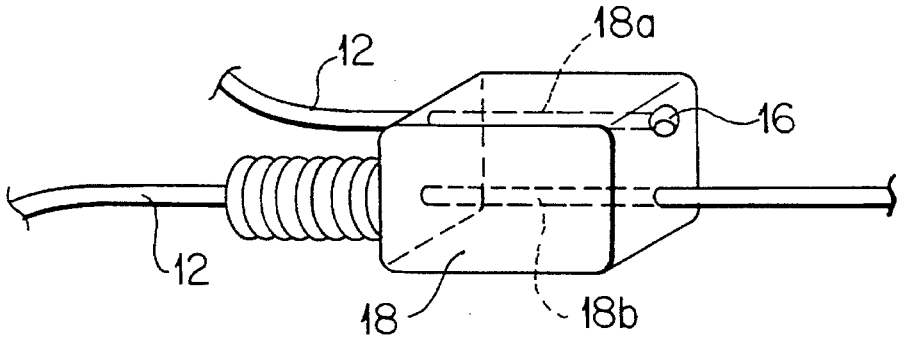
FIG. 2 is a perspective view, partially broken away, of a portion of the adjustable support element of FIG. 1.
Figure 3:
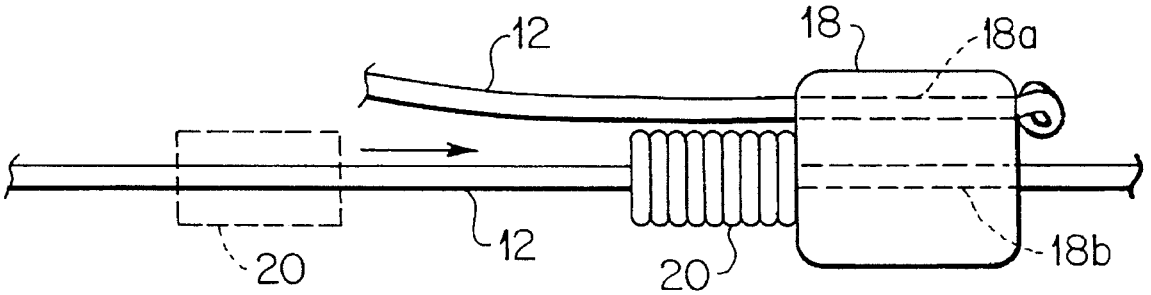
FIG. 3 is a side elevational view of the elements shown in FIG. 2 and illustrating, in dashed and solid lines, two positions of a locking or fixing element.

Referring to FIGS. 1, 2 and 3, the support element 12 is an elongate filamentary element formed into a loop and having a free end as can best be seen in FIG. 1. Support element 12 is preferably a monofilament such as is used for fishing line, and has a diameter between 10 and 30 thousandths of an inch and, preferably, between 12 and 25 thousandths of an inch. The support element 12 includes a stop means 16 at each end thereof. Although other stop means can obviously be provided, stop means 16 is formed by a simple knot in the support element 12, in the exemplary embodiment illustrated (see FIG. 2).

As is perhaps best seen in FIGS. 2 and 3, a first adjustment member or abutment member 18 includes spaced parallel bores **18*a* and 18*b* therein through which two different portions of support element 12 passes so that adjustment member 18 can be moved along the support element 12 within the limits provided by stop means 16. As shown in FIGS. 2 and 3, one end of support element 12, viz., that passing through bore 18*a*, is pulled tight against abutment member 18 so that the stop means 16 at that end abuts against member 18. When this is done, an intermediate portion of support element 12 can be pulled through the other bore 18*b* in member 18 in either direction so as to increase or decrease the size of the loop formed by element 12**.

Figure 4:
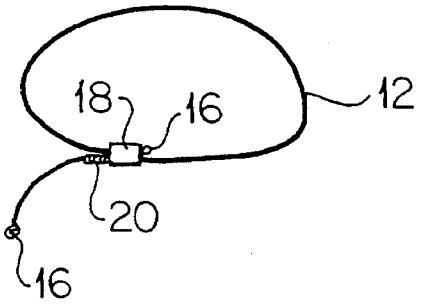
FIGS. 4 and 5 are schematic plan views illustrating the operation of the adjustable support element.
Figure 5:
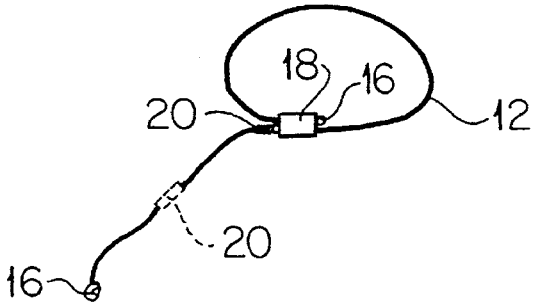

A sliding "lock" or diameter fixing member 20 is used to releasably fix the size (diameter) of the loop formed by element 12. In a preferred embodiment, member 20 comprises a so-called "ice fishing" knot (shown in detail in FIG. 6) made of Dacron or a like material which, when tightened, cinches down on element 12 to provide some compression thereof. When so tied, knot member 20 is very securely affixed to element 12 but is able to slide therealong if substantial force is exerted thereon. Thus, member 20 can be used to temporarily set or,fix the size of the loop formed by support element 12 and can be later released where a different loop size is required. This fixing member 20 provides the "semi-permanent" adjustment of the loop to which reference was made hereinabove. This is illustrated in FIG. 3 wherein member 20 is shown as moving between a first or initial position, which is shown in dashed lines, to a second or "fixing" position, which is shown in solid lines and in which locking member 20 abuts against member 18 to thereby fix the loop size. This is illustrated more particularly in FIGS. 4 and 5, which together show how by moving the locking member 20 along the support element 12 away from the free end thereof opposite that in abutment with member 18, the loop size can be made smaller. FIG. 5 shows in dashed lines the initial position of fixing member 20 (which is the same position as shown in FIG. 4) and shows in solid lines, the new position which creates a smaller loop.

Figure 6:
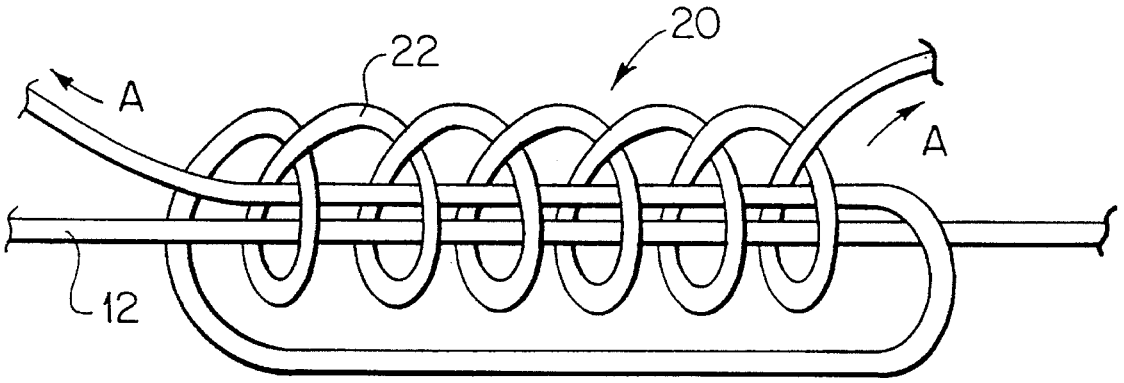
FIG. 6 is a side elevational view illustrating the manner in which a preferred embodiment of the fixing element of FIGS. 1 to 5 is formed.

As shown in FIG. 6, the knot used to form "lock" or diameter fixing member 20 is produced by laying a piece of the Dacron line, denoted 22, alongside support element 12, looping the Dacron line 22 back and thereafter forming a series of loops. The knot is tightened to provide cinching down of the line 22 onto element 12 by pulling on the free ends of the former as indicated by arrows A in FIG. 6. After such tightening of line 22 the protruding ends would then be snipped off.

It will be understood that the releasably fixing or locking member 20 can comprise a different knot from that shown and, more generally, can take other forms as well. Thus, although the embodiment described above provides important advantages with respect to firm holding ability, cost and simplicity, other approaches or embodiments of the fixing member which provide firm but releasably gripping of the support element can also be employed.

Although the present invention has been described relative to specific exemplary embodiments thereof, it will be understood by those skilled in the art that variations and modifications can be effected in these exemplary embodiments without departing from the scope and spirit of the invention.

What is claimed is:

1. An adjustable hair piece construction comprising:

an elongate support element having two free ends and being formed into a loop so as to fit around the head of a wearer;

hair affixed to said loop formed by said support element so as to, in use, hang down therefrom; and adjustment means for adjusting the size of said loop; said adjustment means comprising an abutment member including first and second bores therethrough between first and second ends thereof, portions of said support element extending through each of said first and second bores so that said abutment member is movable on said support element, said support element including stop means at said free ends for capturing said abutment member on said support element between said free ends, said adjustment means further comprising releasable fixing means, movable along said support element between substantially fixed positions, for, in a substantially fixed position thereof and with said first end of said abutment member in engagement with one of said stop means, engaging the second end of abutment member so as to fix the position of said abutment member and thus fix the size of said loop.

2. An adjustable hair piece construction as claimed in claim 1, wherein said stop means comprise individual knots formed in said support element at said free ends.

3. An adjustable hair piece construction as claimed in claim 1, wherein said support element comprises a length of monofilament line.

4. An adjustable hair piece construction as claimed in claim 3, wherein said monofilament line has a diameter of between 10 and 30 thousandths of an inch.

5. An adjustable hair piece construction as claimed in claim 4, wherein said diameter is between 12 and 25 thousandths of an inch.

6. An adjustable hair piece construction as claimed in claim 1 wherein said fixing means comprises a knot tightened down on said support element.

7. An adjustable hair piece construction as claimed in claim 6, wherein said knot is comprised of Dacron.

8. An adjustable hair piece construction as claimed in claim 7 wherein said knot comprises a multiple loop knot.

9. An adjustable hair piece construction as claimed in claim 8 wherein said knot comprises an ice fishing knot.

10. An adjustable hair piece construction as claimed in claim 8, wherein said stop means comprise individual knots formed in said support element at said free ends.

11. An adjustable hair piece construction as claimed in claim 8, wherein said support element comprises a length of monofilament line.

12. An adjustable hair piece construction as claimed in claim 11, wherein said monofilament line has a diameter of between 10 and 30 thousandths of an inch.

13. An adjustable hair piece construction as claimed in claim 12, wherein said diameter is between 12 and 25 thousandths of an inch.

14. An adjustable hair piece construction comprising:

an elongate filamentary support element having two free ends and being formed into a loop so as to fit around the head of a wearer;

hair affixed to said loop formed by said support element so as to, in use, hang down therefrom; and adjustment means for adjusting the size of said loop; said adjustment means comprising an abutment member including first and second bores therethrough between first and second ends thereof, portions of said support element extending through each of said first and second bores so that said abutment member is movable on said support element, said support element including stop means at said free ends for capturing said abutment member on said support element between said free ends, said adjustment means further comprising releasable fixing means, movable along said support element between substantially fixed positions, for, in a substantially fixed position thereof and with said first end of said abutment member in engagement with one of said stop means, engaging the second end of abutment member so as to fix the position of said abutment member and thus fix the size of said loop, said fixing means comprising a multiple loop knot.

15. An adjustable hair piece construction as claimed in claim 14, wherein said stop means comprise individual knots formed in said support element at said free ends.

16. An adjustable hair piece construction as claimed in claim 14, wherein said support element comprises a length of monofilament line and said multiple loop knot is made of Dacron.

17. An adjustable hair piece construction as claimed in claim 16, wherein said monofilament line has a diameter of between 10 and 30 thousandths of an inch.

18. An adjustable hair piece construction as claimed in claim 17, wherein said diameter is between 12 and 25 thousandths of an inch.

* * * * *